US007229527B2

(12) United States Patent
Laine et al.

(10) Patent No.: US 7,229,527 B2
(45) Date of Patent: Jun. 12, 2007

(54) METHOD FOR THE CONTROLLED THICKENING OF LOW CONSISTENCY FIBER SUSPENSIONS

(75) Inventors: Antero Laine, Kotka (FI); Risto Ljokkoi, Karhula (FI); Olavi Pikka, Karhula (FI); Sami Siik, Kymi (FI); Harri Qvintus, Glens Falls, NY (US)

(73) Assignee: Andritz-Ahlstrom Oy, Helsinki (FI)

( * ) Notice: Subject to any disclaimer, the term of this patent is extended or adjusted under 35 U.S.C. 154(b) by 0 days.

(21) Appl. No.: 10/689,665

(22) Filed: Oct. 22, 2003

(65) Prior Publication Data

US 2004/0084160 A1 May 6, 2004

Related U.S. Application Data

(62) Division of application No. 09/787,629, filed as application No. PCT/FI99/00778 on Sep. 22, 1999, now Pat. No. 6,767,432.

(30) Foreign Application Priority Data

Sep. 23, 1998 (FI) ..... 982043
Nov. 26, 1998 (FI) ..... 982565

(51) Int. Cl.
*D21C 9/18* (2006.01)

(52) U.S. Cl. ..... 162/56; 162/380; 210/104; 210/105; 210/107

(58) Field of Classification Search ..... 162/52, 162/56, 380, 246; 210/332, 232, 104, 105, 210/107
See application file for complete search history.

(56) References Cited

U.S. PATENT DOCUMENTS 3,076,610 A * 2/1963 Rosenfeld et al. ..... 241/28
3,682,444 A * 8/1972 Reinhall ..... 259/6
3,833,465 A * 9/1974 Campbell ..... 162/129
4,085,050 A * 4/1978 Gervasi ..... 210/332
4,582,568 A * 4/1986 Iyengar ..... 162/258
4,632,729 A 12/1986 Laakso
4,954,221 A 9/1990 Reinhall et al.
5,034,128 A 7/1991 Hillström
5,147,504 A * 9/1992 Henricson et al. ..... 162/55
5,863,389 A 1/1999 White et al.

OTHER PUBLICATIONS

G.A. Smook, Handbook for Pulp & Paper Technologists, 1982, TAPPI and Canadian Pulp and Paper Association, pp. 109 & 111.*

Grace et al: "Pulp and Paper Manufacture", Third Ed., vol. 5, Alkaline Pulping, pp. 153-155.

* cited by examiner

*Primary Examiner*—Steven P. Griffin
*Assistant Examiner*—Dennis R. Cordray
(74) *Attorney, Agent, or Firm*—Nixon, Vanderhye, P.C.

(57) ABSTRACT

The present invention relates to the thickening of pulp suspensions. A low consistency pulp suspension is fed to a pre-thickener (10) through an inlet conduit (18). A layer of thickened pulp, formed on a filter surface (22), is pushed along the filter surface by a cleaning member to the discharge end of the pre-thickener and is discharged through the outlet (20). The cleaning member comprises a rotating shaft (30), on which shaft at least one screw thread (32) is fixed so as to leave a free space between the shaft and the screw thread. Essentially non-thickened pulp is allowed to flow through the apparatus via this space.

18 Claims, 2 Drawing Sheets

METHOD FOR THE CONTROLLED THICKENING OF LOW CONSISTENCY FIBER SUSPENSIONS

Figure 1:
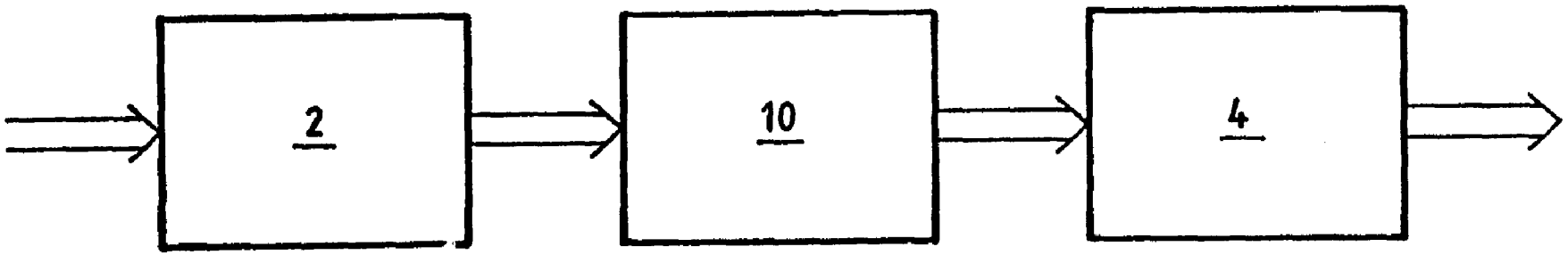

This application is a division of application Ser. No. 09/787,629, now U.S. Pat. No. 6,767,432, filed Mar. 21, 2001, which in turn was the US national phase of international application PCT/FI99/00778 filed Sep. 22, 1999, which designated the U.S., the entire content of which is hereby incorporated by reference in this application.

The present invention relates to a method and apparatus for treating pulp. Preferably the method and apparatus according to the invention are applicable for thickening fiber suspensions of the wood processing industry. The method and apparatus according to the invention are especially preferably suited for applications where liquid is to be removed from fiber suspensions with a relatively low energy consumption, whereby the most obvious applications are pre-thickeners or the like used in connection with various known filters. However, the thickener$_{13}$according to the invention may in some applications be utilized as the actual filter, by means of which consistencies in the range of up to 15 % may be obtained.

Traditionally, fiber suspensions have been screened at a consistency of about 1-2% in connection with chemical and other pulping. Fiber suspensions, i.e. pulp, are easily screened at this consistency, the result being a good purity level of the pulp. After screening the pulp has been thickened normally with suction drum or disc filters to a consistency of about 8-16%. This technology is as such quite serviceable, but low screening consistency increases the costs of pumping and the suction drum and disc filters require a large building volume.

With new technology, screening departments have been introduced in which a screening department feed pump creates a pressure difference, by means of which the pulp is conveyed through the screens and further by means of super-atmospheric pressure in the screens into a closed hydraulic filter. Said technology is described in patent application EP-A-0390403. The advantage of the process described in said publication is that expensive, space-consuming suction drum and disc filters are not needed. A disadvantage of the of the described process is that the screening consistency has had to be raised to a range of 3-5%, which in its turn has caused problems in running and sometimes also pulp impurity problems. The operation of closed hydraulic filters has required a feed consistency of at least 3-5%, which has restricted the possibilities of choosing the screening consistency freely.

An objective of the present invention is to enable the building and running of screening departments so that the consistency in the screening department is arranged to be optimal in view of screening, whereby the consistency of the actual screening is lower than the feeding consistency of the filter whereto the pulp is finally fed. This invention enables the screening to be carried out at a low consistency and still use new efficient closed hydraulic filters. The typical screening consistencies are 2-4% and the typical feeding consistencies of the filter are 3-6%. Thus, the difference in consistency between screening and filter feed is typically 1-3%, mostly 1-2%. Further, it is to be noted that sometimes e.g. the discharge consistency of a process tower and/or apparatus etc. adjacent to it limit the consistency to be too low in view of the subsequent process stage, whereby it is necessary to raise the consistency of the pulp to be appropriate for the subsequent process stage.

The consistency difference between screening and filtering is created using a pre-thickener as shown in FIG. 1 prior to the actual filter. The pre-thickener is preferably pressurized and hydraulically filled with liquid. In that case, the whole screening department, comprising screens, a pre-thickener and the actual filter, operates in a closed space, whereby the amount of odor compounds released into air remains small. The screening consistency is 2-4%, the consistency after the pre-thickener 3-6% and the consistency after the main filter 8-40%, preferably 10-16% when the filter is a washer-type filter and 25-40% when the filter is a press-type filter.

Hydraulic thickeners suitable for increasing the consistency of pulp have been presented earlier. Patent application EP-A-0 298 499 discloses one thickener solution, by means of which the consistency of fiber suspension may be raised from the feeding consistency of 0.3-1.0% to a range of 1.0-5.0% or from the feeding consistency of 3-10% to a range of 10-25%. Thus, it is quite an efficient thickener capable of producing major changes in consistency. This apparatus is, however, too expensive and its operating costs, mainly the energy consumption, make it in practice unpractical e.g. for the present purpose.

Literature discloses simple thickeners consisting of only a perforated tube in which the pulp flows. Such thickeners have been described e.g. in patent publications EP-B-0274690 and SE-C-227590. However, practice has shown that devices as simple as these are not suited for industrial use. Their problem is that although they do operate temporarily, their filter surfaces tend to get clogged periodically and their re-opening or keeping them clean tends to be unsuccessful if they do not have a rotor of some kind. Thus, in connection with the present invention, it has been decided to use an apparatus of another kind, in spite of the fact that, at its lowest, the demand for consistency increase is in the order of one percentage unit, even though in some special circumstances the apparatus may be used to raise the consistency as much as near to 10%. Usually in that case, however, the situation is that the initial consistency of the pulp is already at a relatively high level, at about between 7-10 per cent. To put it more exactly, the apparatus is at its best when the aim is to raise the consistency of the pulp in the apparatus about two-fold. However, it is naturally possible to reach other kinds of changes in the consistency by adjusting the operation of the apparatus. In the present case, the tendency of the filtering surface to get clogged is increased by pressure pulses occurring both in the screening department and its devices, which tend to force fibers into the slots of the filter surface, which in its turn results in the clogging of the filter surface, if a filter surface cleaning means is not used.

Prior art knows also an apparatus according to U.S. patent publication 4,085,050, functioning as a continuously operating filter, which apparatus comprises a vertically arranged cylindrical filter surface, a filtrate chamber arranged outside the filter surface, a centrally open screw thread arranged inside the filter surface and a feed conduit for the material to be filtered and a discharge conduit for the thickened material arranged at the upper and lower ends of the filter surface respectively. The apparatus functions so that a so-called precoat acting as the actual filtering material forms or alternatively is formed on the filter surface. As the material to be filtered is precipitated on this precoat, the screw thread wipes the precipitated layer off letting new material to be precipitated on the precoat layer. Said precoat layer is cleaned by feeding washing liquid through the shaft of the apparatus, which pressurized washing liquid cleans the precoat layer.

U.S. patent publication 4,464,253 describes an apparatus wherein the dry solids content is raised high and the consistent part is discharged via a cone. This kind of procedure is not possible with fiber suspension, because fiber suspension, being consistent, will not flow in a convergent cone. Said patent teaches that the pressure difference required in the filtering process is created by means of the feed pump of the apparatus alone or by means of said feed pump and a vacuum arranged in the filtrate compartments together. The apparatus of this patent is meant to be used so that the material to be filtered is fed into the upper end and the thickened material is discharged from the lower end of the apparatus. The apparatus comprises cylindrical and conical parts and is most obviously meant for high contents of residual dry matter.

Further, U.S. Pat. No. 5,034,128 deals with a similar kind of apparatus for raising the consistency to a range of 5-30 % from a low initial feeding consistency. In this case it is an apparatus, which is specially meant for removing liquid from fiber suspensions of the pulp industry, but the goal is a high increase in consistency and a high final consistency. A characteristic feature of the apparatus is that the screw is closed, i.e. the screw thread is fastened directly to a cylindrical or conical shaft core. The apparatus is further characterized in that the screw thread is arranged so close to the filter surface that it keeps the filter surface clean. In other words, the apparatus functions without a precoat layer. It is our conception, however, that the apparatus cannot function in the way described in the publication, but when pursuing high consistencies, the screw of the apparatus has to be used like a press.

U.S. patent publication 4,582,568 deals with yet another apparatus used in order to thicken fiber suspension by means of a screw press. However, a characteristic feature of this apparatus, unlike a few above-mentioned devices, is that the pressure difference required for the thickening is generated by the screw of the apparatus itself. Said patent publication deals with a combination of a thickener and a screw press, the thickener being meant for raising the consistency of the fiber suspension to correspond to the feeding consistency of the screw press. The function of the thickener is carried out by an apparatus provided with a closed screw surrounded in a small clearance with a filter surface. The fiber suspension is fed into the inlet end of the screw, wherefrom the screw further pushes the suspension against a hydrostatic pressure created by an upward directed discharge conduit arranged at the discharge end of the screw. A problem of the screw thickener described in said patent is that the screw is closed, whereby, as the apparatus stops, the flow of fiber suspension through the apparatus will also stop completely. Another problem is that the operational efficiency of the filter surface is relatively low, because the filter surface functions actively only in the vicinity of the inlet end. This is due to the characteristic feature of the closed screw that it feeds the pulp inside it as an essentially plug-like flow, whereby only the pulp layer facing the filter surface is efficiently thickened, the rest of the pulp passing nearer to the shaft of the screw without being essentially thickened. Liquid is filtrated to the filter surface only through a thickened pulp cake formed on the filter surface and the thickening rate is slow. This results in a highly limited capacity of the device, and raising the capacity is not easy, either, because the problem of the closed screw can only be eliminated by increasing the dimensions of the device.

The prior art apparatuses described above have some disadvantages of which at least the following are worth mentioning:

- in case of an essentially atmospheric "downstream flowing" apparatus provided with an open screw thread (U.S. Pat. No. 4,085,050), the adjustment of the apparatus for cellulose i.e. pulp is difficult. Moving the pulp downwards so that it could be essentially thickened at a consistency of less than 8% is not possible due to the characteristics of the stock.
- in our opinion, a device provided with a closed screw does not function with dilute pulp, i.e. at a consistency of 1-5%, because at the moment when the pulp is fed in under pressure, a flow revolving spirally along the screw thread is immediately generated which flushes off the cake collected onto the filter surface, thus hampering the thickening. If the inlet pressure is very low, the thickening carried out by the apparatus starts well, but when there is a layer of thickened pulp on the filter surface, the thickening is essentially decelerated due to reasons described above in connection with the U.S. Pat. No. 4,582,568. In addition to that, a device provided with a closed screw causes the whole process to stop e.g. in case of actuator breakdown or the like, because even with pulp of low consistency, the thickening of the pulp in the device takes place relatively quickly so that it forms a strong unmovable plug extending throughout the whole diameter of the device.

The apparatus for treating pulp according to the present invention eliminates e.g. said problems of prior art devices. Characteristic features of the apparatus according to the invention are, e.g., that

- according to one embodiment of the invention, pulp is fed from the screens into the apparatus through a closed line preferably utilizing the discharge pressure of the screens as the feeding pressure,
- according to one preferred embodiment, the feeding consistency into the apparatus is 2-4%, preferably 2-3%,
- by means of an apparatus according to one preferred embodiment, the consistency is raised by 1-4%, preferably by 1-2%,
- the discharge consistency utilizing an apparatus according to one preferred embodiment is 3-6%, preferably 4-6%,
- more generally speaking, the feeding consistency of the apparatus may vary in between about 0.8 and 8 per cent, and the discharge consistency, in its turn, may be regulated to between about one and 15 per cent,
- the apparatus according to one preferred embodiment of the invention is coupled between the pressure screen and the filter, whereby it functions so that when the pressure of the pulp in the screen raises above atmospheric pressure, the pre-thickener is pressurized, too, and the pressure prevailing in the screen pushes the filtrate through the filter surface of the pre-thickener,
- the pressure prevailing in an apparatus according to one preferred embodiment of the invention is preferably high enough to feed the pulp into the filter located after the pre-thickener,
- when the apparatus according to one preferred embodiment of the invention is pressurized, the apparatus may be mounted in any position. Thus, e.g. when the apparatus is mounted vertically, the inlet end may be arranged either at the lower or the upper end of the apparatus. And, consequently, the discharge end may be located either at the upper or the lower end,
- it is characteristic of the apparatus according to the invention that fresh pulp is delivered onto the whole length of the filter surface. The filter surface is constantly wiped by one or several screw threads which collect/s to their/its leading side the pulp thickened onto the filter surface and leave to the back side, i.e. their trailing side a cleaned filter surface, onto which fresh pulp flows through the center of the open screw.

Other characteristic features of the method and apparatus according to the invention are disclosed in the appended patent claims.

Figure 2:
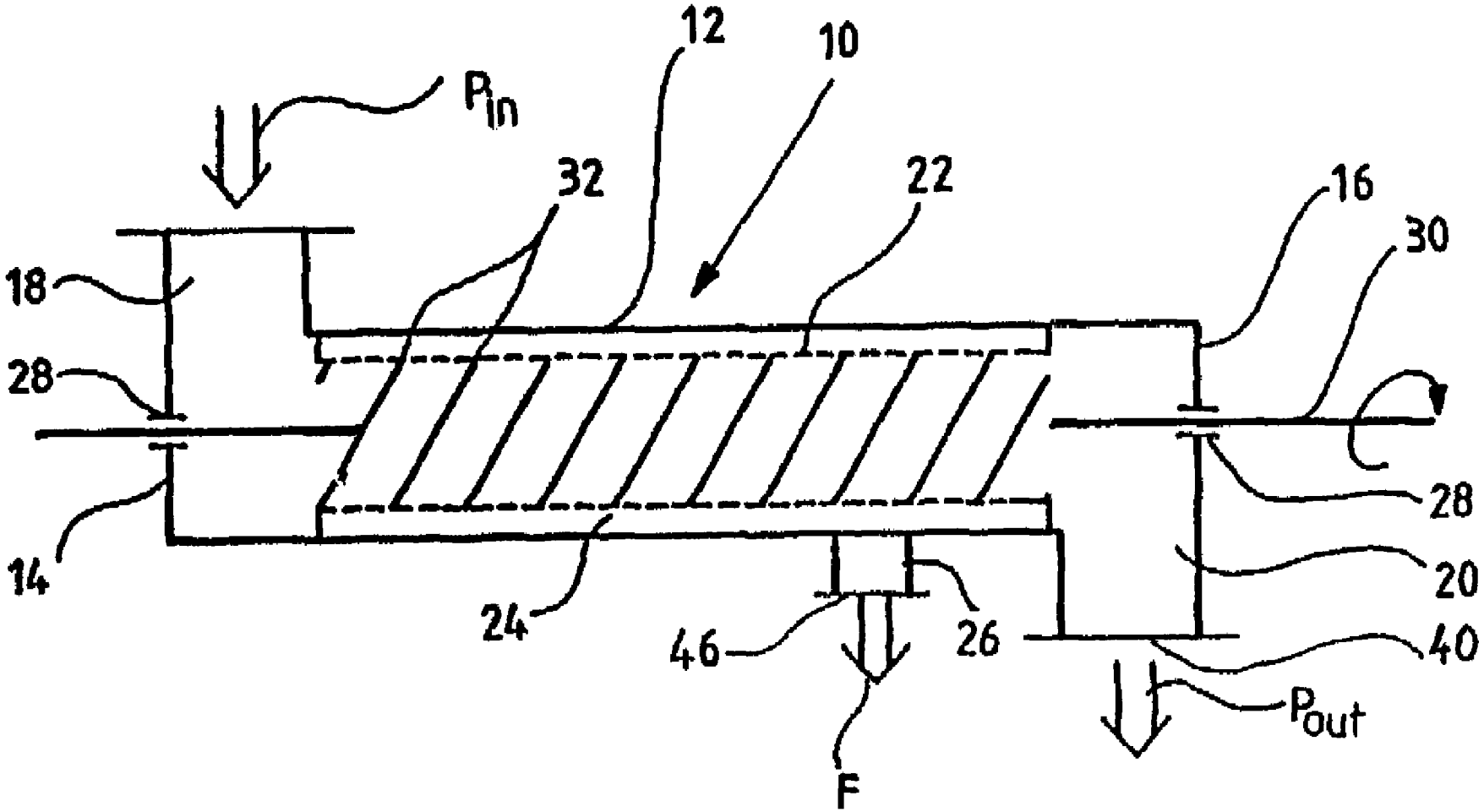

In the following, the method and apparatus for treating pulp according to the invention are explained in more detail with reference to the appended figures, of which FIG. 1 illustrates the apparatus according to the invention positioned in the process, and FIG. 2 illustrates in more detail the apparatus according to one preferred embodiment of the invention.

FIG. 1 illustrates very schematically the positioning of the apparatus 10 according to the invention in a preferable application of the invention, i.e. after the screening department 2 prior to the actual filter 4. When using the apparatus 10 according to the invention, the screening may be carried out at a consistency optimal for the screening result, which is between 2-4%, depending mainly on the pulp and type of screen used. Using the apparatus 10 according to the invention, the consistency of the pulp is raised by a few percentage units to the range of 3-6%, and after that with the actual filter the consistency is raised, depending on the process requirements, either to the MC range of 10-16% or by means of a press-type device to the HC range of 25-40%. In other words, a preferred application of the invention is considered to be the screening department in which the apparatus according to the invention is located after the knotter and the screen prior to the washer or filter subsequent in the process.

FIG. 2 illustrates an apparatus in the form of a pre-thickener 10 according to one preferred embodiment of the invention. The pre-thickener 10 comprises an essentially elongated outer casing 12, the first end of which is closed with an end plate 14 and to the first end of which an inlet conduit 18 for fiber suspension to be treated $P_{in}$ is arranged. The inlet conduit 18 may be coming either, as shown in the figure, from beside the apparatus or from the end of the apparatus, in the axial direction. The inlet conduit 18 may also be radial, tangential or a combination thereof. The other end of outer casing 12 is closed with an end plate 16 and to the other end there is arranged an outlet conduit 20 for thickened fiber suspension $P_{out}$ being discharged from the apparatus. Just like the inlet conduit, the outlet conduit 20 may also be extending radially or tangentially to beside the apparatus or extending axially outwards from the end of the apparatus. The outer casing 12 is further provided with an outlet conduit 26 for the filtrate F. Inside the outer casing 12, essentially at least between the inlet conduit 18 and the outlet conduit 20, there is arranged a filter surface 22 which preferably has a round cross-section. Bearings 28 are arranged at the end plates 14 and 16 of the apparatus 10 or in their vicinity, which bearings support a shaft 30. The shaft 30 is preferably driven by an electric motor, the rotational speed of which is either adjusted to be correct by means of a reduction gear or the rotational speed of which may be regulated by means of an inverter. At least one screw thread 32 is fixed on the shaft 30 so that the thread, according to a preferred embodiment, is positioned centrally inside the filter surface 22 and extends essentially throughout the whole length of the filter surface. In some cases, there may be several screw threads arranged inside each other. The screw thread 32 according to the invention is characterized in that it is positioned via tie rods at a distance from its shaft 30. Valves 40 and 46 are arranged in connection with both the outlet conduit 20 for the thickened pulp and the outlet conduit 26 for the filtrate in order to regulate the functioning of the apparatus.

One reason for arranging the screw to be open is an essential increase in the security of operation of the apparatus. In case of breakdown, the fiber suspension flowing into the apparatus may flow through the hollow center from the inlet opening to the discharge essentially undisturbed. The only disadvantage for the process in that case is that the consistency of the fiber suspension does not decrease in the desired way anymore, but remains essentially the same as the consistency of the pulp being fed into the apparatus. Another reason for arranging the apparatus to be open is that by means of an open screw it is easier to control the formation mechanism of thickened fiber mat than by means of a closed. screw. In a closed screw, in certain circumstances, the fiber suspension having a flow speed above the feeding speed of the screw revolves in a spiral trace along the screw thread of the apparatus, whereby said flow essentially disturbs the formation of the mat. In an open screw, fiber suspension at a low consistency may flow through the open center of the apparatus without disturbing the mat formation. Another remarkable advantage of the open screw may be seen in connection with the actual thickening process. When starting to feed pulp into the apparatus according to the invention, the pulp fills the whole apparatus uniformly. The pulp closest to the filter surface is thickened onto the filter surface, wherefrom the rotating screw thread pushes the pulp further towards the discharge of the apparatus. Friction force between the filter surface and the pulp causes the pulp layer on the filter surface to compress in the axial direction of the apparatus, whereby open filter surface is left behind the screw at the whole length of the screw thread, onto which filter surface fresh fiber suspension is fed. As this thickens, the process described above recurs and new pulp is again delivered to the filter surface.

A so-called scrap trap (not shown) may be arranged at the feeding end of the pre-thickener apparatus 10. In its simplest form, the scrap trap may be a tangential conduit arranged at the end of the apparatus, through which conduit heavy particles collected into the apparatus may be discharged continuously or periodically. The conduit may e.g. be provided with means known per se in order to separate and remove scrap from the apparatus, if desired.

According to a preferred embodiment of the invention, the inner surface of the filter member used in the apparatus is grooved essentially in the axial direction of the apparatus in order to make the thickened fiber mat collected onto to the filter surface to slide along the grooves directly to the discharge of the apparatus. This ensures that the fiber mat cannot cling to the screw and revolve together with it. Naturally, it is also possible to use other guiding means arranged essentially in the axial direction, such as e.g. ledges attached to the filter surface or the like. If the fiber mat would revolve with the screw, the latter would not push the thickened fiber layer to the discharge of the apparatus, but material going to the discharge would be practically non-thickened pulp only.

The apparatus 10 illustrated in FIG. 2 functions so that pulp Pin is fed pressurized into the apparatus from conduit 18, the pressure being usually 1-5 bar, preferably 1-3 bar. Thickened pulp Pout is discharged from the apparatus 10 through conduit 20 pressurized, the pressure being 0-4 bar, preferably 1-3 bar. In a typical application the feed consistency of the pulp is 2.5%, i.e. 40 tons of water per one ton of pulp. In that case, the typical discharge consistency is 4%, i.e. 25 tons of water per one ton of pulp. In other words, with a consistency increase of only 1.5%, almost half of the liquid in the pulp has been removed and the actual filter, wherein the pulp is taken, may be dimensioned for a much smaller water amount. Thus, a surprisingly small increase in the consistency (measured in per cents of consistency) solves problems related to big water amounts in the actual filter. The consistency of pulp being discharged from the apparatus is readily adjusted by changing the position of either the valve 40 for the thickened material or the filtrate valve 46 or both. Just closing the valve 40 for the thickened material increases the pressure inside the screen, whereby a bigger part of water in the suspension is removed into the filtrate. Opening the filtrate valve helps this process, resulting in a major increase in the consistency of the pulp. The removal of the filtrate may be further intensified by arranging a vacuum in the filtrate compartment, the natural result being an increase in the pressure difference prevailing over the filter surface.

The apparatus according to the invention utilizes a filter surface 22, preferably perforated, the diameter of the holes being 0.1-3 mm, preferably 1.0-2.0 mm, greatly depending on the actual application object of the apparatus. The openings of the filter surface may also be slots, the width of which is a little smaller than the hole diameter of a perforated filter member used for a similar purpose. In addition to that, it has been noticed that in some applications it is preferable to use at the inlet end of the apparatus, i.e. in the vicinity of the end through which the pulp is fed into the apparatus, filter openings smaller than elsewhere in the apparatus, which prevent low-consistency fibers from getting into the filtrate.

A pressure difference less than 1.0 bar, preferably less than 0.5 bar, most preferably about 0.3 bar, is maintained over the filter surface. Bigger pressure differences result in higher risk of clogging of the filter surface, as high pressure tends to press the fibers into the openings of the filter surface. The desired pressure difference may be adjusted e.g. so that when the pressure inside the apparatus 10 is 1-5 bar, the outlet flow of the filtrate is throttled by the valve so that the desired pressure difference over the filter surface 22 is obtained. The pressure difference between the filtrate chamber 24 and the inner space of the apparatus is critical in view of the functioning of the apparatus, that is, for the filter surface 22 staying open. Said pressure difference may be considered as one control parameter for the operation of the apparatus. To put it differently, the attempt is to keep the pressure difference constant during the whole thickening process.

The filter surface 22 is aided to keep open, as mentioned earlier, by means of a shaft 30 having both of its ends mounted on bearings 28 to the end plates 14 and 16 of the apparatus and at least one screw thread 32 fixed to the shaft 30. However, in some applications a construction mounted on bearings at the drive end only may be used. The thread/s 32 of the screw is/are arranged at such a distance from the filter surface 22 that the thread/s wipe/s away the thickened pulp from the filter surface and lead/s the thickened material to the discharge without letting the thickened pulp to rotate with the screw. An appropriate distance is under 5 mm, preferably under 3 mm and suitably 0.2-2 mm from the filter surface. In other words, the screw rotates so that it prevents the formation of a permanent pulp layer, a so-called precoat, on the filter surface 22.

The width of the screw thread is also essential for the optimal operation of the apparatus, which width is to be determined individually for every application, because it is naturally effected by both the production and thickening demands set for the apparatus.

The number of screw threads 32 (except for one thread, there may be two or more threads inside each other) and their pitch as well the rotational speed of the screw are selected so that the desired optimal mat formation, i.e. thickening is obtained for each type of pulp. Practice has shown that when using the apparatus used in our tests, the residence time of the fiber suspension in the apparatus should be less than five seconds, because after that no significant thickening occurred with the apparatus used in our tests. It is possible, however, to achieve even longer residence times by significantly modifying the apparatus used in the test. In that case, the constructional characteristics and/or the rotational speed of the screw are selected so that the feeding speed created by the screw (to put it more exactly, the lift speed, if the apparatus is vertical) is less than 3 m/s, preferably between 0.2-1.0 m/s and most preferably about 0.5 m/s. Nevertheless, this is not the actual pulp feed, because the screw does not feed the pulp totally through the apparatus, but only pushes the part of pulp thickened onto the filter surface to the discharge opening of the apparatus. Factors limiting said feeding speed are, e.g., the filtrating speed of the liquid off the fiber suspension and the generation of turbulence between the fiber mat and the filter surface.

In an apparatus according to a preferred embodiment of the invention, the rotational speed of the screw and the pitch were selected so that with the desired thickening range and output, the flow speeds of both the pulp cake fed by the screw to the discharge end and the non-thickened part of the pulp flown thereto through the center of the apparatus were at the discharge end essentially the same. In other words, in said apparatus and said case, the flow speed of the fiber suspension fed into the apparatus was at the inlet end higher than the feeding speed of the screw. Said difference in speed was further compensated as the liquid was filtered from the fiber suspension through the filter surface.

The filtrate being removed from the apparatus may preferably be used for dilution in some other process stage. Especially preferably the filtrate is suited for dilution in the same process stage, i.e. the screening stage. In other words, the filtrate may be led for dilution either to the knotter, or the discharge tank for bottom dilution. Characteristically, the apparatus according to the invention is not used in attempt of minimizing the fiber content of the filtrate, but the main goal is to maximize the efficiency and service reliability of thickening. Accordingly, the fiber content of the filtrate according to our tests is over 100 mg/l, mostly even in the order of 1000 mg/l. Nevertheless, this has no practical significance when the filtrate is returned to a preceding process stage. The fibers may be removed from the filtrate, if so desired, with a separate fiber separator.

It was already mentioned that regulating the thickness of the pulp received from the apparatus is simple. Due to great feeding consistency demands of washers, that is, because the consistency of the pulp in the washer feed must stay practically constant, also the discharge consistency of the pre-thickener according to the present invention must be kept almost constant, exactly at a level corresponding to the consistency demands of the washer subsequent in the process.

That is why the pre-thickener according to the invention is controlled e.g. by measuring various flows, so that the discharge consistency remains within predetermined limits. One way to do this is that when taking each pre-thickener into operation, the flow amount of incoming pulp is measured as well as the amount of filtrate leaving the pre-thickener and the desired discharge consistency is obtained by changing the amount of filtrate. Having thus adjusted the discharge consistency to be correct, the pre-thickener is further controlled so that the ratio of the incoming flow and the filtrate flow remains constant, whereby the discharge consistency is also constant. Assuming that the consistency of pulp coming from the screening department does not change.

In case it is suspected that the consistency might vary, it is possible to provide the system with a device for measuring the consistency of incoming pulp, by means of which device e.g. the filtrate valve is further controlled. As an example of a controlling method taking into account the consistency of incoming pulp, a ratio adjustment may be mentioned, according to which the consistency of the pulp may be effected by changing the ratio of the thickened material and the filtrate. In one application this kind of system gets additional information e.g. from the consistency regulation of the knotters. The consistency control of the knotters may for example inform that it was not capable of adjusting the consistency of the pulp, and the pulp leaving the knotters towards the pre-thickener is too dilute. In that case, by means of ratio adjustment, it is possible to change the ratio of the thickened material and the filtrate and remove more filtrate, whereby the consistency of the pulp leaving the pre-thickener remains unchanged.

Another possible controlling method is e.g. an adjustment based on the power consumption of the drive motor. This controlling method is based on the fact that according to the tests we carried out, an increase in the consistency of the pulp results in an increase in the power requirement of the drive motor of the apparatus. Thus, e.g. in case of increased power requirement, it is possible to decrease the filtrate flow by e.g. throttling the filtrate valve, which results in the initial consistency. And accordingly, in case of decreased power requirement, the filtrate discharge may be intensified by opening the filtrate valve.

As one embodiment based on measuring the power input or torque of the drive motor, controlling the thickening on the base of rotational speed regulation may be considered. On the other hand, it is previously known, as stated above, that increased discharge consistency of the apparatus results in an increased power input. The consistency may, of course, be determined directly from the pulp discharging from the apparatus. Again, on the other hand, our tests have also shown that a change in the rotational speed of the screw is directly proportional to the change in the consistency, because the faster the thread moves (the higher the rotational speed), the thinner the fiber mat on the filter surface is and the better it filtrates liquids, whereby more liquid is released into the filtrate in a unit of time. On the basis of the aforesaid it is possible to aim at decreasing the rotational speed of the thread as the discharge consistency of the pulp increases, which results in a decreased power requirement of the apparatus and, at the same time, a thicker fiber mat is formed on the filter surface decelerating the filtration of liquid from the fiber suspension. Accordingly, in case of decreased discharge consistency of the pulp it would be possible to increase the rotational speed of the screw. It is, naturally, obvious that in practice the rotational speed of the thread has some threshold limits, above or under which it is no more possible to obtain thickening results applicable for industrial purposes.

A further controlling method is pressure difference adjustment based on the fact that with a constant pressure difference the consistency remains constant. By standardizing the feed-in flow of the apparatus and the pressure difference prevailing over the filter surface, the amount of filtrate discharging from the apparatus is directly proportional to the feed-in consistency. In other words, as the feed-in consistency decreases due to more liquid filtrating from dilute pulp than from pulp of higher consistency, more liquid is filtrated from the pulp, whereby a change in the feeding consistency does not effect the discharge consistency, at least not to such a great extent. Accordingly, as the feeding consistency increases, a constant pressure difference allows for a smaller filtrate flow, which also compensates for fluctuations in the feeding consistency.

All said controlling methods as well as other corresponding methods may be utilized either separately or as a combination of several methods. Utilizing state-of-art adjustment and controlling technique with multivariable adjustment and neural networks it is possible to reach a reliable and exact thickening control with adjustment methods mentioned above. According to our tests, the accuracy of the thickener is in the order of +/−3% of the numerical thickness value. In other words, with the thickness of 10 per cent, the error margin is +/−0.3%.

As noticed from the above, a solution has been developed which is essentially simpler and/or at least operationally more secure than prior art pre-thickener solutions, the service reliability and dependability of the solution being of quite a different order compared to prior art apparatus.

The invention claimed is:

1. A method for controllably thickening a pulp comprised of a low consistency fiber suspension, said method comprising the steps of:

introducing a pulp comprised of a low consistency fiber suspension into a pre-thickener apparatus at a feeding pressure, the pre-thickener apparatus having a perforated filter surface, a shaft and a cleaning member attached to the shaft so as to define a space between the shaft and the cleaning member, removing liquid from a portion of the pulp through the perforated filter surface in said pre-thickener apparatus by means of the feeding pressure of the pulp into the pre-thickener apparatus to form a thickened pulp, a filtrate, and an unthickened pulp, allowing a layer of the thickened pulp to be formed on the perforated filter surface of the pre-thickener apparatus, wiping the layer of the thickened pulp off the perforated filter surface of the pre-thickener apparatus with the cleaning member to prevent a permanent precoat pulp layer from forming on the perforated filter surface by pushing the layer of the thickened pulp by the cleaning member in an essentially axial direction along the perforated filter surface to the discharge end of the pre-thickener apparatus to thereby provide an open portion of the perforated filter surface behind the cleaning member onto which unthickened pulp may be deposited, simultaneously while wiping the layer of the thickened pulp off the perforated filter surface allowing the non-thickened pulp to flow through the apparatus from the feeding end to the discharge end via the space defined between the shaft and the cleaning member, discharging from the pre-thickener apparatus the filtrate and the thickened pulp wiped from the perforated filter surface by the cleaning member, guiding a part of the non-thickened pulp to the open portion of the perforated filter surface behind the cleaning member that was provided during wiping of the perforated filter surface;

regulating the flow speed of the pulp in the pre-thickener apparatus by means of valves for the filtrate and the thickened pulp; and controlling the thickening of the pulp in response to input power or input torque of the cleaning member or in response to a pressure difference prevailing over the filter surface.

2. A method according to claim 1, comprising supplying pulp to said pre-thickener apparatus from a screen, the screening consistency of which is about 2-4%.

3. A method according to claim 1, wherein the pulp thickened by the pre-thickener apparatus is taken into a filter, the feeding consistency of which is 3-6%.

4. A method according to claim 2, wherein between the screen and the filter the consistency of the pulp is raised by said pre-thickener by 1-4%.

5. A method according to claim 1, comprising rotating the cleaning member at a rotational speed sufficient to create a flow speed for the layer of the thickened pulp of less than 3 m/s towards the discharge end of the pre-thickener apparatus.

6. A method according to claim 5, wherein said flow speed of the layer of the thickened pulp is between 0.2-1.0 m/s, preferably about 0.5 m/s.

7. A method according to claim 1, wherein the cleaning member comprises a rotatable screw having a selected screw pitch, and wherein the method comprises rotating the screw at a selected rotational speed so that the selected rotational speed and pitch of the screw establish a flow speed of the layer of the thickened pulp being pushed thereby and a flow speed of the non-thickened pulp are essentially the same at the discharge end of the apparatus.

8. A method according to claim 1, further comprising using a pump so as to create the feeding pressure of the pre-thickener apparatus.

9. A method according to claim 1, wherein said step of controlling the thickening of the pulp further comprises regulating the flow of incoming pulp, filtrate and/or thickened pulp with valves.

10. A method according to claim 9, further comprising regulating the consistency of the thickened pulp to a desired value by changing a flow amount ratio between the thickened pulp and the filtrate.

11. A method according to claim 9, further comprising regulating the consistency of the thickened pulp to a desired value by changing a flow amount ratio between the low consistency pulp to be thickened and the filtrate.

12. A method according to claim 9, wherein said step of controlling the thickening of the pulp comprises maintaining a constant pressure difference over the filter surface.

13. A method according to claim 9, wherein said step of controlling the thickening of the pulp further comprises controlling the thickening of the pulp in response to pulp consistency information obtained from a previous or later process stage.

14. A method according to claim 1, wherein said step of controlling the thickening of the pulp further comprises changing the rotational speed of the cleaning member.

15. A method according to claim 1, further comprising using said filtrate for dilution in a previous process stage.

16. A method according to claim 1, further comprising using said filtrate for dilution in the same process stage.

17. A method according to claim 1, further comprising separating fibers from said filtrate by a fiber separating means prior to reusing the filtrate.

18. A method for controllably thickening a pulp comprised of a low consistency fiber suspension, said method comprising the steps of:

introducing a pulp comprised of a low consistency fiber suspension into a pre-thickener apparatus at a feeding pressure, the pre-thickener apparatus having a perforated filter surface, a shaft and a cleaning member attached to the shaft, and a space defined between the shaft and the cleaning member, removing liquid from a portion of the pulp through the perforated filter surface in said pre-thickener apparatus by means of the feeding pressure of the pulp into the pre-thickener apparatus to form a thickened pulp, a filtrate, and an unthickened pulp, allowing a layer of the thickened pulp to be formed on the perforated filter surface of the pre-thickener apparatus, wiping the layer of the thickened pulp off the perforated filter surface of the pre-thickener apparatus with the cleaning member to prevent a permanent precoat pulp layer from forming on the perforated filter surface by pushing the layer of the thickened pulp by the cleaning member in an essentially axial direction along the perforated filter surface to the discharge end of the pre-thickener apparatus to thereby provide an open portion of the perforated filter surface behind the cleaning member onto which unthickened pulp may be deposited, simultaneously while wiping the layer of the thickened pulp off the perforated filter surface, allowing the non-thickened pulp to flow through the apparatus from the feeding end to the discharge end via the space defined between the shaft and the cleaning member, discharging from the pre-thickener apparatus the filtrate and the thickened pulp wiped from the perforated filter surface by the cleaning member guiding a part of the non-thickened pulp to the open portion of the perforated filter surface behind the cleaning member that was provided during wiping of the perforated filter surface;

controlling the thickening of the pulp by measuring the flow of incoming pulp, filtrate and/or thickened pulp, and maintaining a ratio of the incoming pulp flow and the filtrate flow so as to maintain consistency of the thickened pulp discharged from the pre-thickener apparatus, wherein;

the ratio of the incoming pulp flow and the filtrate flow is controlled by valves in response to input power or input torque of the cleaning member or in response to a pressure difference prevailing over the filter surface or in response to a process signal obtained from a previous or later process stage.

* * * * *